US006302979B1

(12) United States Patent
Matsuoka et al.

(10) Patent No.: US 6,302,979 B1
(45) Date of Patent: Oct. 16, 2001

(54) GAS GENERANT COMPOSITION

(75) Inventors: Kazuyuki Matsuoka, Nara; Shogo Tomiyama, Hyogo, both of (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/447,432

(22) Filed: Nov. 23, 1999

Related U.S. Application Data

(62) Division of application No. 08/696,993, filed as application No. PCT/JP95/02622 on Dec. 21, 1995.

(30) Foreign Application Priority Data

| | | |
|---|---|---|
| Dec. 21, 1994 | (JP) | 6-318547 |
| Dec. 21, 1994 | (JP) | 6-318548 |
| Dec. 21, 1994 | (JP) | 6-318549 |
| Dec. 22, 1994 | (JP) | 6-320108 |
| Nov. 14, 1995 | (JP) | 7-295145 |
| Nov. 14, 1995 | (JP) | 7-295146 |
| Nov. 14, 1995 | (JP) | 7-295147 |
| Dec. 7, 1995 | (JP) | 7-318730 |

(51) Int. Cl.[7] ..... C06B 47/08; C06B 31/00

(52) U.S. Cl. ..... 149/36; 149/38; 149/45; 149/110; 149/114

(58) Field of Search ..... 149/36, 45, 110, 149/114, 38

(56) References Cited

U.S. PATENT DOCUMENTS

| | | | | |
|---|---|---|---|---|
| 2,939,780 | * | 6/1960 | Brock et al. | 149/110 X |
| 3,862,866 | | 1/1975 | Timmerman et al. | 149/21 |
| 4,369,079 | | 1/1983 | Shaw | 149/2 |
| 4,370,181 | | 1/1983 | Lundstrom et al. | 149/2 |
| 4,948,439 | | 8/1990 | Poole et al. | 149/96 |
| 5,019,220 | | 5/1991 | Taylor et al. | 264/3.4 |
| 5,061,675 | | 10/1991 | Ebata et al. | 502/324 |
| 5,223,184 | | 6/1993 | Taylor et al. | 264/3.4 |
| 5,460,667 | | 10/1995 | Moriyuki et al. | 149/36 |
| 5,551,725 | | 9/1996 | Ludwig | 280/737 |
| 5,589,661 | | 12/1996 | Menke et al. | 149/19.4 |
| 5,661,261 | * | 8/1997 | Ramaswamy et al. | 149/36 |
| 5,725,699 | | 3/1998 | Hinshaw et al. | 149/19.1 |
| 5,739,460 | | 4/1998 | Knowlton et al. | 102/324 |
| 5,756,930 | * | 5/1998 | Chan et al. | 149/35 X |
| 5,773,754 | * | 6/1998 | Yamato | 149/36 |
| 5,780,767 | * | 7/1998 | Matsuda et al. | 149/45 X |
| 5,844,164 | * | 12/1998 | Cabrera | 149/36 X |
| 6,017,404 | * | 1/2000 | Lundstrom et al. | 11/36 |

FOREIGN PATENT DOCUMENTS

| | | |
|---|---|---|
| 1593320 | 8/1966 | (DE) . |
| 0607446A1 | 7/1994 | (EP) . |
| 523620 | 1/1977 | (JP) . |
| 646156B2 | 2/1989 | (JP) . |
| 646157B2 | 2/1989 | (JP) . |
| 368447A | 3/1991 | (JP) . |
| 3208878A | 9/1991 | (JP) . |
| 5213687A | 8/1993 | (JP) . |
| 632689A | 2/1994 | (JP) . |
| 632690A | 2/1994 | (JP) . |
| 6227884A | 8/1994 | (JP) . |
| 6239683A | 8/1994 | (JP) . |

* cited by examiner

*Primary Examiner*—Peter A. Nelson
(74) *Attorney, Agent, or Firm*—Birch, Stewart, Kolasch & Birch, LLP

(57) ABSTRACT

A gas generant is provided which decreases toxic components, in particular carbon monoxide and nitrogen oxides, in generated gas to a concentration practical as an air bag system for automobile.

A nitrogen-containing organic compound such as a compound containing amino group or amido group or a tetrazole derivative and a oxygen-containing inorganic oxidizer such as $KNO_3$, $Sr(NO_3)_2$ or $KClO_4$ are essential components. Therewith one or more metal oxides are contained in the mixed catalyst of the gas generant composition. The oxide is selected from manganese dioxide having a specific surface area not less than 50 $m^2/g$; copper oxide having a specific surface area not less than 1 $m^2/g$; molybdenum oxides such as molybdenum dioxide, molybdenum trioxide, molybdic acid and ammonium molybdate: and copper oxides, cobalt oxides, iron oxides and silver oxides.

15 Claims, No Drawings

GAS GENERANT COMPOSITION

This application is a division of Ser. No. 08/696,993 filed Aug. 21, 1996 which is a 371 of PCT/JP 95/02622 filed Dec. 21, 1995.

FIELD OF THE INVENTION

The present invention relates to a gas generant composition. More specifically, the invention relates to a non-azide type gas generator composition which supplies gas components by burning for the purpose of inflating an air bag system.

RELATED ART

In the event of collision of vehicles like cars at high speed, the driver and passengers might be injured or killed by clashing against internal hard or dangerous parts of the vehicles such as the handle and front glass. In order to prevent such disasters, air bag systems for automobiles have is been developed which inflate quickly by a gas generated from a gas generant.

Requirements for the gas generant of an automobile air bag system are very severe. At first, the bag should inflate in a very short period of time, usually not longer than 40 to 50 milliseconds. Further, The atmosphere within the bag is most suitable when it corresponds to the air composition in the car. These requirements are satisfied by gas generants which have been currently used in common comprising a base gas generant such as alkali metal salts (in particular sodium azide) or alkaline earth metal salts of hydrazoic acid. However, these gas generants are seriously defective in that the main component, sodium azide is toxic and that the by-products alkali components are also toxic. Hence, environmental pollution brought by a large amount of scrap cars and health hazard of the driver and passengers when the gas is generated are concerned.

For the purpose of overcoming these problems, non-azide type gas generants have been under development in place of sodium azide type. For example, JP-A 3-208878 discloses a composition which comprises a main component of oxygen-containing oxidizer such as tetrazole, triazole, or their metal salts combined with ammonium perchlorate or sodium nitrate and an auxiliary component of a metal oxide such as $V_2O_5$, CuO or $Fe_2O_3$. The metal oxide mentioned forms a solid combustion product, which is easily removed by filtration when undesired components are removed by filtration prior to release the formed gas into the bag in an air bag system, and converts CO which is toxic to human bodies generated from the nitrogen-containing organic compound to $CO_2$. JP-B 64-6156 and JP-B 64-6157 disclose a gas generant which contains, as the main component, a metal salt of bitetrazole compound that does not contain hydrogen. JP-A-5-213687 further discloses a gas generant having a transition metal complex of aminoarazole as the main component. These non-azide type compounds disclosed in the series of prior art references are characteristic in that the concentration of carbon monoxide released is low since the carbon number in the one molecule is small; however, the amount of nitrogen oxides, toxic to human bodies, increases in all the cases and the performance is not satisfactory in respect of the inflation period of the bag.

It is described in JP-A 6-32689, JP-A 6-32690 and JP-A 8-227884 that a non-azide type gas generant having a nitrogen-containing organic compound such as azodicarbonamide and a certain inorganic oxygen-containing oxidizer as the effective component is free from environmental pollution, satisfactory in respect of the inflation period of the bag, and advantageous in the cost.

In the combustion of an organic compound containing oxygen, it is well-known that carbon monoxide will generate as incomplete combustion product even when an oxidizer is used in an amount exceeding the chemical equivalence that releases the necessary amount of oxygen for burning combustible elements, such as carbon, hydrogen and others, in the organic compound. In view of this fact, the nitrogen compound, such as azodicarbonamide, used as the main agent in the mentioned gas generant is supposed to release a relatively rather large amount of carbon monoxide and nitrogen oxides since many carbon atoms are contained per molecule. For the purpose of avoiding such by-product carbon monoxide, use of a catalyst may be possible which convert carbon monoxide to carbon dioxide. Many components are known for such catalysts as written in a book "Classified Table for Catalysts depending on Reaction, Vol. I" edited by Tarama et al. of Kyoto University and published by Kagaku Kogyo-sha (see pp. 291–292). However, no catalysts are known that are generally reactive enough in a contact period of time of several dozens milliseconds as required for a gas generant for air bag system; $V_2O_5$, CuO, $Fe_2O_3$ and other metal oxides are used at present in spite of their low activity. There are rarely known catalysts that decompose nitrogen oxides in the absence of a reductant. In addition, when a gas generant burns, the highest temperature in the inflator exceeds 2,000° C. and the oxygen molecules existing in surplus react with the nitrogen molecules released whereby a large amount of nitrogen oxides called "thermal NOx" is generated. Toxicity of the NOx contained in a large amount in the released gas is said to be a main reason why non-azide type gas generants are not used in practice notwithstanding many studies. It is desirable to convert NOx to $N_2$ by some means for reducing the NOx. Many references including patents and papers for NOx reduction suggest that a catalyst might reduce NOx, which comes from a fixed source of automobile exhaust gas, to a certain level in the presence of a reductant. However, there are rarely known catalysts that are reactive enough in a contact period of time of several dozens milliseconds, as required for a gas generant for air bag system, without addition of a reductant.

DISCLOSURE OF THE INVENTION

The present invention relates to a gas generant composition which comprises a nitrogen-containing organic compound, an oxygen-containing inorganic oxidizer, and a third component of at least one selected from the following (1) through (4):

(1) manganese dioxide having a specific surface area not less than 50 $m^2/g$;

(2) copper oxide having a specific surface area not less than 1 $m^2/g$;

(3) a molybdenum compound of at least one selected from the group consisting of molybdenum dioxide, molybdenum trioxide, molybdic acid and ammonium molybdate; and (4) a mixture of manganese dioxide and at least one metal oxide selected from the group consisting of copper oxides, cobalt oxides, iron oxides and silver oxides.

The third component may be a blend of two or more.

Furthermore, the present invention provides an air bag system that contains the composition mentioned above in the air bag system as the gas generant; that is, a gas generant in an air bag system is improved by the present invention.

Among the preferable compositions, the following compositions are listed: a composition wherein the third component is (1) mentioned above and has a specific surface area from 100 $m^2/g$ to 300 $m^2/g$; a composition wherein (1) in the third component is contained in an amount of 1 through 40 or 1 through 30 percent by weight of the composition; a composition wherein the third component is (2) mentioned above and has a specific surface area from 1.5 $m^2/g$ to 100 $m^2/g$; a composition wherein the third component is (2) having an average particle size not more than 5 microns; a composition wherein the third component is (2) having an average particle size from 0.5 microns to 5 microns; a composition wherein (2) in the third component is contained in an amount of 1 through 40 percent by weight of the composition; a composition wherein (3) mentioned above in the third component is contained in an amount of 1 through 40 or 1 through 30 percent by weight of the composition; a composition wherein the metal oxide is at least one selected from the group consisting of CuO, $Cu_2O$, $Co_3O_4$, $Fe_2O_3$ and $Ag_2O$; a composition wherein the third component is (4) mentioned above and the ratio of manganese dioxide to the metal oxide by weight is 0.2 through 50; a composition wherein (4) in the third component is contained in an amount of 1 through 40 percent by weight of the composition; a composition wherein the nitrogen-containing organic compound is at least one selected from the group consisting of organic compounds containing amino group or amido group and tetrazole derivatives; a composition wherein the organic compound containing amino group or amido group is azodicarbonamide or dicyandiamide; a composition wherein the tetrazole derivative is aminotetrazole; a composition wherein the oxygen-containing inorganic oxidizer is at least one selected from the group consisting of $KNO_3$, $Sr(NO_3)_2$ and $KClO_4$; a composition wherein the oxygen-containing inorganic oxidizer is a mixture of $Sr(NO_3)_2$ and $KClO_4$; a composition wherein the nitrogen-containing organic compound is azodicarbonamide and the oxygen-containing inorganic oxidizer is $KClO_4$; and a composition wherein the third component is (2) and has a specific surface area not less than 1 $m^2/g$ and an average particle size not more than 5 microns.

The present inventors have intensively studied for overcoming the problems mentioned above and have found, surprisingly, that manganese dioxide having a certain physical property has an important function for decreasing carbon monoxide and nitrogen oxides; this finding has lead to completion of a first embodiment of the present invention.

According to the first embodiment of the present invention, a gas generant composition containing a nitrogen-containing organic compound and an oxygen-containing inorganic oxidizer as the essential components is provided, which composition is characterized by containing manganese dioxide having a specific surface area not less than 50 $m^2/g$.

Also as a result of intensive studies of the present inventors, it has been found that copper oxide, used in prior art, has an important function for the capability of oxidizing carbon monoxide when the copper oxide has a certain physical property; this finding has lead to completion of a second embodiment of the present invention.

According to the second embodiment of the present invention, a gas generant composition containing a nitrogen-containing organic compound and an oxygen-containing inorganic oxidizer as the essential components is provided, which composition is characterized by containing copper oxide having a specific surface area not less than 1 $m^2/g$.

Further, as a result of intensive studies of the present inventors, it has been surprisingly found that a certain molybdenum compound has an important function for decreasing carbon monoxide and nitrogen oxides; this finding has lead to completion of a third embodiment of the present invention.

According to the third embodiment of the present invention, a gas generant composition containing a nitrogen-containing organic compound and an oxygen-containing inorganic oxidizer as the essential components is provided, which composition is characterized by containing a molybdenum compound comprising at least one selected from the group consisting of molybdenum dioxide, molybdenum trioxide, molybdic acid and ammonium molybdate.

Furthermore, as a result of intensive studies of the present inventors, it has been surprisingly found that a combination of manganese dioxide and a certain oxide has an important function for decreasing nitrogen oxides; this finding has lead to completion of a fourth embodiment of the present invention.

According to the fourth embodiment of the present invention, a gas generant composition containing a nitrogen-containing organic compound and an oxygen-containing inorganic oxidizer as the essential components is provided, which composition is characterized by containing a mixture of one or more metal oxides selected from the group consisting of copper oxides, cobalt oxides, iron oxides and silver oxides.

A fifth embodiment of the present invention is what contains two or more of the third components; the two or more may be either two or more from respective groups of (1) through (4), or two or more of each one selected from different groups of (1) through (4); in particular, a combination of two or more of each one selected from (1), (2) and (3); and, thereby, carbon monoxide and nitrogen oxides are decreased.

BEST MODE FOR CARRYING OUT THE INVENTION

The gas generant composition of the present invention contains a nitrogen-containing organic compound and a oxygen-containing inorganic oxidizer as the essential components.

There is no particular limitation for the nitrogen-containing organic compound usable for the present invention provided that nitrogen atom is contained in the molecule; examples of the nitrogen-containing organic compound include organic compounds containing amino group or amido group and tetrazole derivatives. Specific examples of the organic compounds containing amino group or amido group include: azodicarbonamide, urea, aminoguanidine bicarbonate, biuret, dicyandiamide, and hydrazides; preferably azodicarbonamide or dicyandiamide; and most preferably azodicarbonamide. Specific examples of the tetrazole derivatives include: aminotetrazole, tetrazole, azotetrazole, bitetrazole, tetrazole carboxylate, their alkali metal salts and their alkaline earth metal salts; and preferably aminotetrazole. The nitrogen-containing organic compound may be used in single or as a mixture of two or more kinds.

The oxygen-containing inorganic oxidizer usable in the present invention may be selected widely from known ones such as nitrates, nitrites, and oxyhalogenates. Specific examples of the oxygen-containing inorganic oxidizer include potassium nitrate, sodium nitrate, strontium nitrate, potassium nitrite, sodium nitrite, sodium perchlorate, potassium perchlorate, sodium chlorate, and potassium chlorate. More specifically, a single compound or mixture selected from $KNO_3$, $Sr(NO_3)_2$ and $KClO_4$ may be used; $KClO_4$ is preferable in particular.

The blend ratio of the nitrogen-containing organic compound to oxygen-containing inorganic oxidizer in the gas generant composition of the present invention may be optionally selected depending on the combustion rate, combustion temperature and combustion temperature, although the ratio is normally selected so as to be stoichiometric when the nitrogen-containing organic compound is completely oxidized and burned on the basis of the oxygen amount. For example, about 20 through 400 parts by weight of the oxygen-containing inorganic oxidizer is blended with 100 parts by weight of the nitrogen-containing organic compound; blending some excess amount of the oxygen-containing inorganic oxidizer compared to the stoichiometric amount for complete combustion is preferred for enhancing the efficiency of oxidizer catalyst provided that the gas generation efficiency based on the unit weight of the gas generant composition is not substantially lowered.

According to the first embodiment of the present invention, in a gas generant composition containing a nitrogen-containing organic compound and an oxygen-containing inorganic oxidizer as the essential components, manganese dioxide having a specific surface area not less than 50 $m^2/g$, preferably 100–300 $m^2/g$, is further blended as the oxidation catalyst. Use of manganese dioxide of specific surface area less than 50 $m^2/g$ does not bring the effect of decreasing carbon monoxide and nitrogen oxides in the generated gas.

The manganese dioxide can be produced by a process known to the art. For example, a process described in a book "Handbook of Catalysts Classified by Elements" edited by Shokubai Gakkai and published by Chijin Shokan (see pp. 411–412) or a process disclosed in DE 1,593,320 or in JP-A 3-68447 may be adopted; in order to get the manganese dioxide having a specific surface area not less than 50 $m^2/g$, drying the prepared manganese dioxide at a temperature not higher than 200° C. is preferable. Higher drying temperature is not desirable because it will decrease the surface area and lower the activity due to reduction of a part of the manganese dioxide. While the manganese dioxide usable in the present invention is obtained by the mentioned process, the preparation process is not limited specifically as long as the specific surface area is not less than 50 $m^2/g$. The particle size of manganese dioxide is not limited specifically as well; however, fine powder such as 0.5 $\mu$ or less is not preferable because of excessive load for the filter in filtration step.

According to the second embodiment of the present invention, in a gas generant composition containing a nitrogen-containing organic compound and an oxygen-containing inorganic oxidizer as the essential components, copper oxide having a specific surface area not less than 1 $m^2/g$, preferably 1.5–100 $m^2/g$, is further blended as the oxidation catalyst. Use of copper oxide of specific surface area less than 1 $m^2/g$ does not bring the effect of decreasing carbon monoxide in the generated gas.

The copper oxide can be produced by a process known to the art. For example, aqueous solution of caustic soda or ammonia is added to aqueous solution of copper chloride to yield copper hydroxide, which is turned to copper oxide by baking. The baking is generally preferred to be done near the temperature at which copper hydroxide is decomposed to copper oxide since higher baking temperature will not bring copper oxide having a large surface area; specifically, practical baking temperature is from 200 to 500° C. Copper oxide is also produced by addition of an alkali carbonate solution to a divalent copper salt solution to prepare basic copper carbonate, followed by baking. Further, copper oxide is also produced by electrolysis of aqueous sodium chloride using copper plates for both electrodes to produce cuprous oxide, which is baked to turn into copper oxide. Copper oxide produced by various processes as mentioned is crushed by an atomizer, ball mill or other device; thereby, the copper oxide used in the present invention is obtained. However, any copper oxide having a specific surface area not less than 1 $m^2/g$ is acceptable and its production process is not limited. The particle size of copper oxide is not limited specifically as well; however, generally 5 $\mu$ or less is preferable and the range from 0.5 through 5 $\mu$ is more preferable. Exceed 5 $\mu$ is not preferable because of low activity and fine powder such as 0.5 $\mu$ or less is not preferable because of excessive load for the filter in filtration step.

According to the third embodiment of the present invention, in a gas generant composition containing a nitrogen-containing organic compound and an oxygen-containing inorganic oxidizer as the essential components, a molybdenum compound of at least one selected from the group consisting of molybdenum dioxide, molybdenum trioxide, molybdic acid and ammonium molybdate, is further blended. The molybdenum oxide type catalyst mentioned above can be produced by a process known to the art.

According to the fourth embodiment of the present invention, in a gas generant composition containing a nitrogen-containing organic compound and an oxygen-containing inorganic oxidizer as the essential components, a mixture of manganese dioxide and at least one metal oxide selected from the group consisting of copper oxides, cobalt oxides, iron oxides and silver oxides is further blended. Similarly, methods for preparing the mentioned metal oxides usable in the present invention are not limited specifically. Among the metal oxides mentioned above, at least one selected from the group consisting of CuO, $Cu_2O$, $Co_3O_4$, $Fe_2O_3$ and $Ag_{20}$ is effective in the present invention.

The manganese dioxide may have a specific surface area of both 50 $m^2/g$ or larger and less than 50 $m^2/g$.

The ratio of manganese dioxide to the one or more metal oxides selected from the group consisting of copper oxides, cobalt oxides, iron oxides and silver oxides is preferably 0.2 through 50. The particle size of the mixture of manganese dioxide and the above metal oxides is not limited specifically as well; however, fine powder such as 0.5 $\mu$ or less is not generally preferable because of excessive load for the filter in filtration step.

In the first embodiment of the present invention, the content of manganese dioxide is not limited, but normally 1 through 40% by weight or 1 through 30% by weight, preferably 3 through 20% by weight, and more preferably 3 through 10% by weight, of the total weight of the composition that includes the gas generant containing the nitrogen-containing organic compound and oxygen-containing inorganic oxidizer as the essential components and blended optional additives such as a decomposition promoter for accelerating the decomposition and a binder for enhancing the strength when shaped. Too much manganese dioxide content is not desirable because the amount of generated gas is decreased against unit weight of the gas generant composition; and too little content is not desirable because the effect of decreasing toxic gas concentration is unsatisfactory.

In the second embodiment of the present invention, the content of copper oxide is not limited, but normally 1 through 40% by weight, preferably 3 through 30% by weight, and more preferably 3 through 25% by weight or 3 through 20% by weight, of the total weight of the composition that includes the gas generant containing the nitrogen-containing organic compound and oxygen-containing inorganic oxidizer as the essential components and blended optional additives as mentioned above. Too much copper oxide content is not desirable because the amount of generated gas is decreased against unit weight of the gas generant composition; and too little content is not desirable because the effect of decreasing toxic gas concentration is unsatisfactory.

In the third embodiment of the present invention, the content of molybdenum compound is not limited, but normally 1 through 40% by weight or 1 through 30% by weight, preferably 3 through 30% by weight or 3 through 20% by weight, and more preferably 3 through 20% by weight or 3 through 10% by weight, of the total weight of the composition that includes the gas generant containing the nitrogen-containing organic compound and oxygen-containing inorganic oxidizer as the essential components and blended optional additives as mentioned above. Too much molybdenum oxide catalyst content is not desirable because the amount of generated gas is decreased against unit weight of the gas generant composition; and too little content is not desirable because the effect of decreasing toxic gas concentration is unsatisfactory.

In the fourth embodiment of the present invention, the content of the specified mixture is not limited, but normally 1 through 40% by weight, preferably 3 through 30% by weight, and more preferably 3 through 20% by weight or 3 through 15% by weight, of the total weight of the composition that includes the gas generant containing the nitrogen-containing organic compound and oxygen-containing inorganic oxidizer as the essential components and blended optional additives as mentioned above. Too much specified mixture content is not desirable because the amount of generated gas is decreased against unit weight of the gas generant composition; and too little content is not desirable because the effect of decreasing toxic gas concentration is unsatisfactory.

In the fifth embodiment, the amount of two or more third components is as desired, but normally 1 through 40% by weight, preferably 3 through 30% by weight, and more preferably 3 through 20% by weight or 3 through 15% by weight, of the total weight of the composition.

To the composition of the present invention, a decomposition promoter for accelerating the decomposition of nitrogen-containing organic compound may be blended additionally. As for such decomposition promoter, the selection may be made widely from inorganic oxides and organic decomposition promoters. The inorganic oxide decomposition promoters, usable in combination, may be at least one of oxides, chlorides and carbonates of an element selected from the group belonging to Groups I, II, III, IV, V, VI (except molybdenum), VII and VIII of the periodic table. Examples of such elements include boron, cerium, barium, calcium, vanadium, manganese, iron, cobalt, nickel, copper, zinc, titanium, antimony, lead and ytterbium. Examples of such oxides, chlorides and carbonates include $B_2O_3$, $Co_3O_4$, NiO, CuO, ZnO, $ZnCO_3$, $MnO_2$, $FeCl_3$, $Pb_3O_4$, $PbO_2$, PbO, $Sb_2O_3$, $TiO_2$, $V_2O_5$, $CeO_2$, $Ba_2O_3$, $CaO_2$, and $Yb_2O_3$. Most preferable is CuO.

When at least one of oxides, chlorides and carbonates of an element selected from the group belonging to Groups I, II, III, IV, V, VI (except molybdenum), VII and VIII of the periodic table is used additionally, the content is preferably from 1 to 30% by weight of the composition of the present invention. An example of the organic decomposition promoter is urea.

For the purpose of enhancing the shaped strength of the gas generant composition, a binder may be blended. Examples of the binder include: fine crystal binders such as marketed under the trade name "Avicel"; polymer binders such as poval; organic binders such as starch; and inorganic binders such as silica gel, alumina sol, and zirconia sol.

The composition according to the present invention is prepared by blending respective components mentioned above; resulting blended composition may be used as such for a gas generant, however, a formulated form is preferable. Any known methods are applicable for the formulation, and a suitable binder may be selected. Shape of the formulated composition is not limited specifically and may be, for example, pellet, disc, ball, like-confetti , and like-tetrapod. The formulated composition may be without holes or with holes (such as briquette with holes or ring shape).

According to the present invention, in a gas generant composition containing a nitrogen-containing organic compound and an oxygen-containing inorganic oxidizer as the essential components, toxic components in the released gas, in particular carbon monoxide and nitrogen oxides, can be reduced to a practical level which is acceptable as an air bag system for automobile.

EXAMPLE

Now, the present invention is explained more specifically concerning the first to fifth embodiments by way of examples; however, the present invention is not limited to these examples if not out of the scope and spirit of the invention.

Hereinafter, "parts" and "%" are based on weight unless otherwise specified.

First Embodiment

Example 1-1

Powders consisting of 8 parts of DM-90 (manganese dioxide: specific surface area—260 $m^2/g$ (by nitrogen adsorption method)) marketed by TOYO CCI corporation, 45 parts of azodicarbonamide, 55 parts of potassium perchlorate, and 10 parts of copper oxide were blended well; furthermore, 5% aqueous solution of a soluble starch was added therewith so that the starch content be 0.55 parts. Resulting humid fine particles were adjusted to suitable fineness and water content for shape formulation, and formed into pellets (9.7 mm length×4 mm diameter). The pellets were subjected to a predetermined tank test (as described in JP-B 52-3620 and JP-B 64-6156) using a burning device equipped with a filter and coolant; thereby, the concentration of carbon monoxide in the gas generated in the tank was evaluated. The burning pressure and period were of desired values. The concentration of carbon monoxide in the gas generated in the tank was determined to be 0.8% by gas chromatography. The nitrogen oxides were 1,000 ppm as determined by a gas detector tube. Example 1-2

Example 1-1 was repeated except that EO8T (manganese dioxide: specific surface area—104 $m^2/g$ (by nitrogen adsorption method)) marketed by NIKKI KAGAKU was used as the manganese dioxide. The concentration of carbon monoxide and nitrogen oxides in the gas generated in the tank was evaluated in the same way as Example 1-1. The burning pressure and period were of desired values. The gas generated in the tank was found to contain 1.1% of carbon monoxide and 1,300 ppm of nitrogen oxides.

Comparative Example 1-1-1

Example 1-1 was repeated except that the manganese dioxide was not added. The concentration of carbon monoxide and nitrogen oxides in the gas generated in the tank was evaluated in the same way as Example 1-1. The burning pressure and period were of desired values. The gas generated in the tank was found to contain 2.3% of carbon monoxide and not less than 2,000 ppm of nitrogen oxides.

Comparative Example 1-1-2

Example 1-1 was repeated except that Manganese Dioxide (manganese dioxide: specific surface area—21.5 $m^2/g$ (by nitrogen adsorption method)) marketed by NAKARAI TESQUE, INC. was used as the manganese dioxide. The concentration of carbon monoxide and nitrogen oxides in the gas generated in the tank was evaluated in the same way as Example 1-1. The burning pressure and period were of desired values. The gas generated in the tank was found to contain 2.5% of carbon monoxide and 2000 ppm of nitrogen oxides.

Example 1-3

Example 1-1 was repeated except that the amount of the manganese dioxide was increased to 10 parts. The concentration of carbon monoxide and nitrogen oxides in the gas generated in the tank was evaluated in the same way as Example 1-1. The burning pressure and period were of desired values. The gas generated in the tank was found to contain 0.6% of carbon monoxide and 700 ppm of nitrogen oxides.

Second Embodiment

Example 2-1

Ten parts of Copper Oxide uF (specific surface area—4.99 $m^2/g$ (by nitrogen adsorption method), average particle size—1.06 $\mu$) marketed by NIKKO FINE PRODUCTS CO., LTD., 45 parts of azodicarbonamide, and 55 parts of potassium perchlorate, 10 parts of copper oxide were blended; furthermore, 5% aqueous solution of a soluble starch is added therewith so that the starch content be 0.55 parts. Resulting humid fine particles were adjusted to suitable fineness and water content for shape formulation, and formed into pellets (9.7 mm$\phi$×4 mm). The pellets were subjected to a predetermined tank test (as described in JP-B 52-3620 and JP-B 64-6156) using a burning device equipped with a filter and coolant; thereby, the concentration of carbon monoxide in the gas generated in the tank was evaluated. The burning pressure and period were of desired values. The concentration of carbon monoxide in the gas generated in the tank was determined to be 0.3% by gas chromatography.

Example 2-2

Example 2-1 was repeated except that Copper Oxide F (specific surface area—1.68 $m^2/g$ (by nitrogen adsorption method), average particle size—2.09 $\mu$) marketed by NIKKO FINE PRODUCTS CO., LTD., was used as the copper oxide to evaluate the concentration of carbon monoxide in the gas generated in the tank. The burning pressure and period were of desired values. The concentration of carbon monoxide in the gas generated in the tank was determined to be 1.3% by gas chromatography.

Example 2-3

Example 2-1 was repeated except that Copper Oxide (specific surface area—10.16 $m^2/g$ (by nitrogen adsorption method), average particle size—8.46 $\mu$) marketed by NAKARAITESK was used as the copper oxide to evaluate the concentration of carbon monoxide in the gas generated in the tank. The burning pressure and period were of desired values. The concentration of carbon monoxide in the gas generated in the tank was determined to be 1.3% by gas chromatography.

Comparative Example 2-2-1

Example 2-1 was repeated except that the copper oxide was not added to evaluate the concentration of carbon monoxide in the gas generated in the tank. The burning pressure and period were of desired values. The concentration of carbon monoxide in the gas generated in the tank was determined to be 3.3% by gas chromatography.

Comparative Example 2-2-2

The copper oxide used in Example 2-3, marketed by NAKARAI TESQUE, INC., was baked at 800° C. under air flow and pulverized thereafter; thereby, a copper oxide catalyst was prepared having a specific surface area of 0.31 $m^2/g$. Example 2-1 was repeated except that the copper oxide used was the copper oxide catalyst thus prepared to evaluate the concentration of carbon monoxide in the gas generated in the tank. The burning pressure and period were of desired values. The concentration of carbon monoxide in the gas generated in the tank was determined to be 3.1% by gas chromatography.

Example 2-4

Example 2-1 was repeated except that N-300 (specific surface area—1.26 $m^2/g$ (by nitrogen adsorption method), average particle size—1.98 $\mu$) marketed by NISSIN CHEMCO was used as the copper oxide to evaluate the concentration of carbon monoxide in the gas generated in the tank. The burning pressure and period were of desired values. The concentration of carbon monoxide in the gas generated in the tank was determined to be 1.4% by gas chromatography.

Example 2–5

Mixed powder consisting of 10 parts of N-300 (specific surface area—1.26 $m^2/g$ (by nitrogen adsorption method), average particle size—1.98 $\mu$) marketed by Nissin CHEMC0, Ltd., 24 parts of dicyandiamide and 76 parts of potassium nitrate was adjusted to suitable fineness for shape formulation, and formed into pellets (5 mm diameter×1.5 mm). The pellets were subjected to the same tank test as Example 2-1 and the concentration of carbon monoxide in the gas generated in the tank was evaluated. The burning pressure and period were of desired values. The concentration of carbon monoxide in the gas generated in the tank was determined to be 0.1% by gas chromatography.

Example 2-6

Mixed powder consisting of 30 parts of N-300 (specific surface area—1.26 $m^2/g$ (by nitrogen adsorption method), average particle size—1.98 $\phi$) marketed by Nissin CHEMCO, Ltd., 19 parts of dicyandiamide and 51 parts of potassium nitrate was adjusted to suitable fineness for shape formulation, and formed into pellets (5 mm diameter×1.5 mm). The pellets were subjected to the same tank test as Example 2-1 and the concentration of carbon monoxide in the gas generated in the tank was evaluated. The burning pressure and period were of desired values. The concentration of carbon monoxide in the gas generated in the tank was determined to be 0.2% by gas chromatography.

Comparative Example 2-2-3

Mixed powder consisting of 27 parts of dicyandiamide and 73 parts of potassium nitrate was adjusted to suitable fineness for shape formulation, and formed into pellets (5 mm diameter×1.5 mm). The pellets were subjected to the same tank test as Example 2-1 and the concentration of carbon monoxide in the gas generated in the tank was evaluated. The burning pressure and period were of desired values. The concentration of carbon monoxide in the gas generated in the tank was determined to be 2.3% by gas chromatography.

Comparative Example 2-2-4

Mixed powder consisting of 10 parts of the baked product used in Comparative Example 2-2-2 (specific surface area—0.31 $m^2/g$) of the copper oxide marketed by NAKARAI TESQUE, INC., 24 parts of dicyandiamide and 76 parts of potassium nitrate was adjusted to suitable fineness for shape formulation, and formed into pellets (5 mm diameter×1.5 mm). The pellets were subjected to the same tank test as Example 2-1 and the concentration of carbon monoxide in the gas generated in the tank was evaluated. The burning pressure and period were of desired values. The concentration of carbon monoxide in the gas generated in the tank was determined to be 2.3% by gas chromatography.

Third Embodiment

Example 3-1

Powders consisting of 36 parts of azodicarbonamide, 32 parts of potassium perchlorate, 32 parts of strontium nitrate, and 20 parts of molybdenum trioxide were blended well; furthermore, an amount of 5% aqueous solution to be resulted to 0.2 parts of poval was added therewith. Resulting humid fine particles were adjusted to suitable fineness and water content for shape formulation, and formed into pellets (9.7 mm diameter×4 mm) by pressing at a pressure of about 120 $kg/cm^2$ using a hydraulic tabletting machine. The pellets were subjected to a predetermined tank test (as described in JP-B 52-3620 and JP-B 64-6156) using a burning device equipped with a filter and coolant; thereby, the concentration of carbon monoxide and nitrogen oxides in the gas generated in the tank was evaluated. The burning pressure and period were of desired values. The concentration of carbon monoxide in the gas generated in the tank was determined to be 0.6% by gas chromatography. The nitrogen oxides were 200 ppm as determined by a detector tube.

Example 3-2

Example 3-1 was repeated except 20 parts of molybdic acid was used in place of the 20 parts of molybdenum trioxide to evaluate the concentration of carbon monoxide and nitrogen oxides in the gas generated in the tank. The burning pressure and period were of nearly same values as Example 1. The concentration of carbon monoxide in the gas generated in the tank was determined to be 0.4% by gas chromatography. The nitrogen oxides were 180 ppm as determined by a detector tube.

Example 3-3

Example 3-1 was repeated except 20 parts of ammonium molybdate was used in place of the 20 parts of molybdenum trioxide to evaluate the concentration of carbon monoxide and nitrogen oxides in the gas generated in the tank. The burning pressure and period were of nearly same values as Example 1. The concentration of carbon monoxide in the gas generated in the tank was determined to be 0.5% by gas chromatography. The nitrogen oxides were 100 ppm as determined by a detector tube.

Comparative Example 3-3-1

Example 3-1 was repeated except that the 20 parts of molybdenum trioxide was not used to evaluate the concentration of carbon monoxide and nitrogen oxides in the gas generated in the tank. The burning pressure and period were of nearly same values as Example 3-1. The concentration of carbon monoxide in the gas generated in the tank was determined to be 2.3% by gas chromatography. The nitrogen oxides were not less than 2,000 ppm as determined by a detector tube.

Example 3-4

Example 3-1 was repeated except 20 parts of molybdenum trioxide was replaced by 10 parts of copper oxide and 10 parts of molybdenum trioxide to evaluate the concentration of carbon monoxide and nitrogen oxides in the gas generated in the tank. The burning pressure and period were of nearly same values as Example 3-1. The concentration of carbon monoxide in the gas generated in the tank was determined to be 0.7% by gas chromatography. The nitrogen oxides were 320 ppm as determined by a detector tube.

Example 3-5

Example 3-1 was repeated except 20 parts of molybdenum trioxide was replaced by 10 parts of copper oxide and 10 parts of molybdic acid to evaluate the concentration of carbon monoxide and nitrogen oxides in the gas generated in the tank. The burning pressure and period were of nearly same values as Example 3-1. The concentration of carbon monoxide in the gas generated in the tank was determined to be 0.6% by gas chromatography. The nitrogen oxides were 270 ppm as determined by a detector tube.

Example 3-6

Example 3-1 was repeated except 20 parts of molybdenum trioxide was replaced by 10 parts of copper oxide and 10 parts of ammonium molybdate to evaluate the concentration of carbon monoxide and nitrogen oxides in the gas generated in the tank. The burning pressure and period were of nearly same values as Example 3-1. The concentration of carbon monoxide in the gas generated in the tank was determined to be 0.5% by gas chromatography. The nitrogen oxides were 230 ppm as determined by a detector tube.

Comparative Example 3-3-2

Example 3-1 was repeated except 20 parts of molybdenum trioxide was replaced by 10 parts of copper oxide to evaluate the concentration of carbon monoxide and nitrogen oxides in the gas generated in the tank. The burning pressure and period were of nearly same values as Example 3-1. The concentration of carbon monoxide in the gas generated in the tank was determined to be 1.5% by gas chromatography. The nitrogen oxides were not less than 2,000 ppm as determined by a detector tube.

Comparative Example 3-3-3

Example 3-1 was repeated except 20 parts of molybdenum trioxide was replaced by 20 parts of copper oxide to evaluate the concentration of carbon monoxide and nitrogen oxides in the gas generated in the tank. The burning pressure and period were of nearly same values as Example 3-1. The concentration of carbon monoxide in the gas generated in the tank was determined to be 1.4% by gas chromatography. The nitrogen oxides were not less than 2,000 ppm as determined by a detector tube.

Fourth Embodiment

Example 4-1

Ten parts of manganese dioxide (manufactured by NAKARAI TESQUE, INC.), 10 parts of copper (II) oxide (N-300, manufactured by Nissin CHEMCO, Ltd.), 30 parts of azodicarbonamide, 35 parts of potassium perchlorate and 35 parts of strontium nitrate were mixed well; furthermore, 5% aqueous solution of a soluble starch was added therewith so that the starch content be 0.55 parts. Resulting humid fine particles were adjusted to suitable fineness and water content for shape formulation, and formed into pellets (9.7 mm diameter×4 mm length). The pellets were subjected to a predetermined tank test (as described in JP-B 52-3620 and JP-B 64-6156) using a burning device equipped with a filter and coolant; thereby, the concentration of nitrogen oxides in the gas generated in the tank was evaluated. The burning pressure and period were of desired values. The concentration of nitrogen oxides in the gas generated in the tank was 600 ppm as determined by a gas detector tube.

Example 4-2

Example 4-1 was repeated except that 10 parts of copper (II) oxide was replaced by 10 parts of tricobalt tetroxide (manufactured by NAKARAI TESQUE, INC.) to evaluate the concentration of nitrogen oxides in the gas generated in the tank. The burning pressure and period were of desired values. The concentration of nitrogen oxides in the gas generated in the tank was 500 ppm.

Example 4-3

Example 4-1 was repeated except that 10 parts of copper (II) oxide was replaced by 10 parts of iron (III) oxide (manufactured by NAKARAI TESQUE, INC.) to evaluate the concentration of nitrogen oxides in the gas generated in the tank. The burning pressure and period were of desired values. The concentration of nitrogen oxides in the gas generated in the tank was 700 ppm.

Example 4-4

Example 4-1 was repeated except that 10 parts of copper (II) oxide was replaced by 10 parts of silver (I) oxide (manufactured by NAKARAI TESQUE, INC.) to evaluate the concentration of nitrogen oxides in the gas generated in the tank. The burning pressure and period were of desired values. The concentration of nitrogen oxides in the gas generated in the tank was 650 ppm.

Example 4-5

Example 4-1 was repeated except that 10 parts of copper (II) oxide was replaced by 10 parts of copper (I) oxide (manufactured by NAKARAI TESQUE, INC.) to evaluate the concentration of nitrogen oxides in the gas generated in the tank. The burning pressure and period were of desired values. The concentration of nitrogen oxides in the gas generated in the tank was 600 ppm.

Comparative Example 4-4-1

Example 4-1 was repeated except that manganese dioxide and copper oxide were not added to evaluate the concentration of nitrogen oxides in the gas generated in the tank. The burning pressure and period were of desired values. The concentration of nitrogen oxides in the gas generated in the tank was not less than 2,000 ppm.

Comparative Example 4-4-2

Example 4-1 was repeated except that 10 parts of copper (II) oxide was not added to evaluate the concentration of nitrogen oxides in the gas generated in the tank. The burning pressure and period were of desired values. The concentration of nitrogen oxides in the gas generated in the tank was not less than 2,000 ppm.

Comparative Example 4-4-3

Example 4-1 was repeated except that 10 parts of manganese dioxide was not added to evaluate the concentration of nitrogen oxides in the gas generated in the tank. The burning pressure and period were of desired values. The concentration of nitrogen oxides in the gas generated in the tank was not less than 2,000 ppm.

Example 4-6

Example 4-1 was repeated except that 5 parts of silver (II) oxide was further added to the starting mixture to evaluate the concentration of nitrogen oxides in the gas generated in the tank. The burning pressure and period were of desired values. The concentration of nitrogen oxides in the gas generated in the tank was 440 ppm.

Example 4-7

Example 4-2 was repeated except that 5 parts of silver (II) oxide was further added to the starting mixture to evaluate the concentration of nitrogen oxides in the gas generated in the tank. The burning pressure and period were of desired values. The concentration of nitrogen oxides in the gas generated in the tank was 370 ppm.

Example 4-8

Example 1 was repeated except that the amount of catalyst addition was changed to 25 parts of manganese dioxide and 2 parts of copper (II) oxide to evaluate the concentration of nitrogen oxides in the gas generated in the tank. The burning pressure and period were of desired values. The concentration of nitrogen oxides in the gas generated in the tank was 630 ppm.

Example 4-9

Example 4-1 was repeated except that the amount of catalyst addition was changed to 20 parts of manganese dioxide and 0.5 parts of copper (II) oxide to evaluate the concentration of nitrogen oxides in the gas generated in the tank. The burning pressure and period were of desired values. The concentration of nitrogen oxides in the gas generated in the tank was 1,240 ppm.

Fifth Embodiment

Example 5-1

Eight parts of DM-90 (manganese dioxide: specific surface area—260 $m^2/g$ (by nitrogen adsorption method)) marketed by TOYO CCI, 5 parts of Copper Oxide uF (specific surface area—4.99 $m^2/g$ (by nitrogen adsorption method)) marketed by NIKKO FINE PRODUCTS CO., LTD., 45 parts of azodicarbonamide, 55 parts of potassium perchlorate, and 10 parts of copper oxide were blended; furthermore, 5% aqueous solution of a soluble starch was added therewith so that the starch content be 0.55 parts. Resulting humid fine particles were adjusted to suitable fineness and water content for shape formulation, and formed into pellets (9.7 mm diameter×4 mm). The pellets were subjected to a predetermined tank test (as described in JP-B 52-3620 and JP-B 64-6156) using a burning device equipped with a filter and coolant; thereby, the concentration of carbon monoxide and nitrogen oxides in the gas generated in the tank was evaluated. The burning pressure and period were of desired values. The concentration of carbon monoxide in the gas generated in the tank was determined to be 0.4% by gas chromatography. The nitrogen oxides were 1000 ppm as determined by a gas detector tube.

Example 5-2

Example 5-1 was repeated except that 5 parts of copper loxide was replaced by 10 parts of molybdenum trioxide to evaluate the concentration of carbon monoxide and nitrogen oxides in the gas generated in the tank. The burning pressure and period were of desired values. The gas generated in the tank was found to contain 0.6% of carbon monoxide and 280 ppm of nitrogen oxides.

Example 5-3

Example 5-1 was repeated except that 5 parts of copper oxide was replaced by 10 parts of iron oxide to evaluate the concentration of carbon monoxide and nitrogen oxides in the gas generated in the tank. The burning pressure and period were of desired values. The gas generated in the tank was found to contain 0.8% of carbon monoxide and 580 ppm of nitrogen oxides.

Example 5-4

Ten parts of molybdic acid, 10 parts of Copper Oxide $\mu$F (specific surface area—4.99 $m^2/g$ (by nitrogen adsorption method)) marketed by NIKKO FINE PRODUCTS CO., LTD., 36 parts of azodicarbonamide, 32 parts of potassium perchlorate, and 32 parts of strontium nitrate were blended; furthermore, 5% aqueous solution of a soluble starch was added therewith so that the starch content be 0.55 parts. Resulting humid fine particles were adjusted to suitable fineness and water content for shape formulation, and formed into pellets (9.7 mm diameter×4 mm). The pellets were subjected to a predetermined tank test (as described in JP-B 52-3620 and JP-B 64-6156) using a burning device equipped with a filter and coolant; thereby, the concentration of carbon monoxide and nitrogen oxides in the gas generated in the tank was evaluated. The burning pressure and period were of desired values. The concentration of carbon monoxide in the gas generated in the tank was determined to be 0.4% by gas chromatography. The nitrogen oxides were 250 ppm as determined by a gas detector tube.

Example 5-5

In the starting mixture of Example 5-4, 10 parts of Copper Oxide $\mu$F (specific surface area—4.99 $m^2/g$ (by nitrogen adsorption method)) was changed to 5 parts and 5 parts of DM-90 (manganese dioxide: specific surface area 260 $m^2/g$ (by nitrogen adsorption method)) marketed by TOYO CCI was added. Except for these changes, Example 5-4 was repeated to evaluate the concentration of carbon monoxide and nitrogen oxides. The burning pressure and period were of desired values. The gas generated in the tank was found to contain 0.4% of carbon monoxide and 240 ppm of nitrogen oxides.

What is claimed is:

1. A gas generant composition comprising a nitrogen-containing organic compound, an oxygen-containing inorganic oxidizer, and a copper oxide having a specific surface area not less than 1 $m^2/g$ and an average particle size of not more than 5 $\mu$.

2. The composition according to claim 1 wherein the copper oxide has an average particle size from 0.5 microns to 5 microns.

3. The composition according to claim 1 wherein the copper oxide is contained in an amount of 1 through 40% by weight of the composition.

4. The composition according to claim 1 wherein the copper oxide has a specific surface area from 1.5 $m^2/g$ to 100 $m^2/g$.

5. The composition according to claim 1 wherein the nitrogen-containing organic compound is at least one selected from the group consisting of organic compounds containing amino group or amido group and tetrazole derivatives.

6. The composition according to claim 5 wherein the organic compound containing amino group or amido group is azodicarbonamide or dicyandiamide.

7. The composition according to claim 1 wherein the oxygen-containing inorganic oxidizer is at least one selected from the group consisting of $KNO_3$, $Sr(NO_3)_2$ and $KClO_4$.

8. The composition according to claim 1 wherein the oxygen-containing inorganic oxidizer is a mixture of $Sr(NO_3)_2$ and $KClO_4$.

9. The composition according to claim 1 wherein the nitrogen-containing organic compound is azodicarbonamide and the oxygen-containing inorganic oxidizer is $KClO_4$.

10. An airbag system wherein the composition according claim 1 is contained as the gas generant.

11. A gas generant composition comprising a nitrogen-containing organic compound, an oxygen-containing inorganic oxidizer, and a copper oxide having a specific surface area not less than 1 $m^2/g$ and an average particle size of not more than 5 $\mu$;

wherein the composition does not include an alkali metal salt or alkaline earth metal salt of hydrazoic acid.

12. The composition according to claim 1, further comprising a decomposition promoter for accelerating the decomposition of the nitrogen-containing organic compound.

13. The composition according to claim 1, wherein the nitrogen-containing organic compound is an organic compound containing an amino group or a tetrazole derivative.

14. The composition according to claim 1, wherein the nitrogen-containing organic compound is dicyandiamide or aminotetrazole.

15. The composition according to claim 1, wherein the nitrogen-containing organic compound is an organic compound containing an amino group.

* * * * *